US007167573B2

(12) United States Patent
Williamson

(10) Patent No.: US 7,167,573 B2
(45) Date of Patent: Jan. 23, 2007

(54) FULL RANGE LOUDSPEAKER

(75) Inventor: Clayton C. Williamson, Moorpark, CA (US)

(73) Assignee: Harman International Industries, Incorporated, Northridge, CA (US)

( * ) Notice: Subject to any disclaimer, the term of this patent is extended or adjusted under 35 U.S.C. 154(b) by 0 days.

(21) Appl. No.: 10/406,067

(22) Filed: Apr. 2, 2003

(65) Prior Publication Data

US 2003/0190051 A1 Oct. 9, 2003

(51) Int. Cl.
*H04R 1/00* (2006.01)
*H04R 9/06* (2006.01)
*H04R 11/02* (2006.01)

(52) U.S. Cl. ..... 381/403; 381/430; 381/398; 381/431

(58) Field of Classification Search ..... 381/398, 381/386, 392, 395, 403–405, 407, 412, 423, 381/396–397, 430–431; 181/150, 171–172, 181/199

See application file for complete search history.

(56) References Cited

U.S. PATENT DOCUMENTS 1,559,596 A 11/1925 Williams
2,201,059 A * 5/1940 Stephan ..... 381/404
2,231,479 A * 2/1941 Perry ..... 381/186
2,814,353 A * 11/1957 Olson et al. ..... 181/172
2,942,071 A * 6/1960 Witchey ..... 381/340
2,974,204 A * 3/1961 Supitilov ..... 381/420
3,328,537 A * 6/1967 Hecht ..... 381/426
3,665,352 A 5/1972 Dietrich et al.
3,814,857 A * 6/1974 Thomasen ..... 381/99
3,867,587 A 2/1975 Yamamuro
3,922,501 A 11/1975 Yamamuro
3,955,055 A 5/1976 Kawakami et al.
3,991,286 A 11/1976 Henricksen
4,016,376 A 4/1977 Neuhof ..... 179/115 R
4,190,746 A * 2/1980 Harwood et al. ..... 381/427
4,289,937 A 9/1981 Ikeda et al.
5,008,945 A * 4/1991 Murayama et al. ..... 381/409
5,150,419 A 9/1992 Kizak et al. ..... 381/194
5,157,731 A 10/1992 Mitobe ..... 381/202
5,339,286 A 8/1994 Esposto
5,381,483 A 1/1995 Grau
5,548,657 A * 8/1996 Fincham ..... 381/182
5,715,324 A 2/1998 Tanabe et al.
5,727,077 A 3/1998 Frasi
5,848,173 A 12/1998 Sato et al.
6,069,965 A * 5/2000 Takewa et al. ..... 381/404
6,075,866 A 6/2000 Frasi et al.

(Continued)

*Primary Examiner*—Curtis Kuntz
*Assistant Examiner*—P. Dabney
(74) *Attorney, Agent, or Firm*—The Eclipse Group LLP

(57) ABSTRACT

An edge-driven diaphragm loudspeaker driver is configured such that the suspension system of the driver is connected to the voice coil rather than to the diaphragm. Thus, the diaphragm in the loudspeaker is free of suspension systems connected to or extending from the diaphragm. By attaching the surround suspension to the voice coil rather than to the diaphragm, the diaphragm is isolated from the influence of spurious high frequency vibrations in the suspension system, thereby increasing the performance of the loudspeaker at high frequencies. The loudspeaker driver configuration also provides for a longer excursion range for the voice coil/diaphragm assembly, which allows for the driver components to be more accurately aligned during manufacturing, thereby enabling the loudspeaker driver to operate as a full range unit by producing low output frequencies.

58 Claims, 2 Drawing Sheets

U.S. PATENT DOCUMENTS 6,154,556 A 11/2000 Takahashi
6,394,224 B1 * 5/2002 Liu ..... 181/171
6,490,363 B1 * 12/2002 Liu ..... 381/403
6,526,151 B1 * 2/2003 Peng ..... 381/403
6,647,122 B1 * 11/2003 Jones ..... 381/182

* cited by examiner

FULL RANGE LOUDSPEAKER

CROSS REFERENCE TO RELATED APPLICATIONS

This application claims priority of U.S. provisional application Ser. No. 60/093,600 filed Jul. 21, 1998 and U.S. application Ser. No. 09/346,954, filed Jul. 1, 1999, both incorporated by reference into this application.

BACKGROUND OF THE INVENTION

1. Field of Invention

The invention relates to the field of loudspeakers and more particularly to the configuration of a loudspeaker driver suspension system.

2. Related Art

The general construction of a loudspeaker driver consists of a diaphragm, voice coil, magnetic motor, frame and suspension system. The magnetic motor is generally attached to the frame. The voice coil and diaphragm are then mounted to the frame via the suspension system, which may include one or more suspension members. The voice coil of the driver typically consists of a voice coil former having a wire wound about the lower portion of the voice coil former. Often times, although not necessary, the voice coil former is encased in a wrapper. The suspension system of the driver acts to provide the stiffness of the driver and also provide air sealing for the driver. The configuration of the voice coil and diaphragm in the frame via the suspension system depends generally upon the design and size of the diaphragm relative to the voice coil.

Loudspeakers are generally of two common construction types. The first construction type is a conventional dual-suspension driver construction where the diaphragm of the driver is formed as a cone and is substantially greater in diameter than the voice coil. In this type of construction, two suspension members are generally utilized. A "surround" suspension member is connected to the diaphragm at its outer edge and extends outward from the diaphragm to connect the diaphragm to the frame. Similarly, a "spider" suspension is connected to the voice coil and extends from the voice coil to the frame, connecting the voice coil to the frame.

The second type of driver construction is an edge-driven-diaphragm driver. In this construction, the diaphragm and the voice coil are of substantially equal diameter. The outer edge of the diaphragm is then attached to the diaphragm to form a diaphragm assembly. This assembly is then attached to the voice coil. The surround suspension assembly extends outward to connect the assembly to the frame. This edge-driven-diaphragm driver construction is often found in smaller speaker assemblies, such as tweeters, and sometimes in mid-range speakers.

One common problem with smaller sized loudspeakers is as the size of the loudspeakers becomes smaller, achieving acceptable low frequency response becomes more difficult. This is because the loudspeaker is required to displace a larger volume of air to achieve the lower frequencies, and the suspension stiffness must be reduced to maintain a low resonance corresponding to the lighter mass of the smaller driver. The volume of air that a loudspeaker can displace is dependent upon the area of the diaphragm and the range of motion allowed by the suspension, i.e., amount of vibrational excursion, or volume displacement, of the loudspeaker. Additionally, higher suspension stiffness acts to reduce the motion of the diaphragm for a given input, so a minimum of stiffness is desired. Since smaller loudspeakers have a smaller diaphragm and stiffer suspension, the volume displacement, and thus the performance, is limited by the ability to manufacture loudspeakers with very low stiffness and high excursion capabilities.

To operate efficiently, the suspension system in smaller loudspeakers, such as those found in edge-driven diaphragm speakers, must allow a required maximum amplitude of vibration while constraining the vibrational movement essentially to a straight-line path to avoid the voice coil contacting the surrounding structure. Thus, the surround suspension member is required to constrain the diaphragm against any tilting, rocking or other extraneous vibration while allowing maximum possible amplitude of desired vibration. A general problem with the current construction of edge-driven speakers is the difficulty of precisely aligning the components during manufacturing, as the magnetic air gap is shielded by the diaphragm. This forces the removal of all alignment gauges prior to the placement of the diaphragm/coil assembly, and thus causes uncertainty in location of the voice coil relative to the motor. This is commonly known as a "blind" assembly.

An additional general problem with the current construction of loudspeakers is that spurious vibration of portions of the surround suspension members occur at high audio frequencies. These spurious vibrations may be transmitted to the diaphragm through the suspension, thereby degrading the high frequency performance of the speakers. Furthermore, with the current loudspeaker construction, the maximum amplitude of vibration is limited in smaller sized loudspeakers, preventing low frequency responses from the smaller diameter speakers.

A need therefore exists for a loudspeaker construction that minimizes the effect of the spurious vibration of the suspension system on the diaphragm and that increases the amount of excursion of the voice coil/diaphragm assembly to provide low frequency response in smaller diameter loudspeaker systems.

SUMMARY

The loudspeaker driver of the invention is designed so that the suspension system of the driver is connected to the voice coil former rather than to the diaphragm. In particular, the edge-driven voice coil/diaphragm assembly is supported by a single surround suspension member attached to the tubular voice coil former in a location spaced at a predetermined distance from the point at which the voice coil former attaches to the diaphragm. Thus, the diaphragm in the driver construction is free of suspension systems connected to or extending from the diaphragm. By attaching the surround suspension to the voice coil former rather than to the diaphragm, the diaphragm is isolated from the influence of spurious high frequency vibrations in the suspension system. Thus, the performance of the loudspeaker driver at high frequencies is improved.

Additionally, by attaching the suspension to the voice coil former rather than the diaphragm, the loudspeaker driver configuration provides for a longer excursion range for the voice coil/diaphragm assembly. By attaching the diaphragm to the voice coil former, the driver components can be more accurately aligned during manufacture, which enables the driver to operate a higher excursion rate. Thus, the loudspeaker driver is able to operate as a full range unit, producing acoustic output at frequencies generally lower than those produced by typical loudspeaker constructions of a similar size and shape.

The driver construction may be utilized in edge-driven diaphragm drivers utilizing both concave and convex domed diaphragms. When limited by size constraints, as with miniature loudspeakers for use in laptop computers, the concave diaphragm is preferred because a more compact driver configuration can be achieved.

Other systems, methods, features and advantages of the invention will be or will become apparent to one with skill in the art upon examination of the following figures and detailed description. It is intended that all such additional systems, methods, features and advantages be included within this description, be within the scope of the invention, and be protected by the accompanying claims.

BRIEF DESCRIPTION OF THE DRAWINGS

The invention can be better understood with reference to the following figures. The components in the figures are not necessarily to scale, emphasis instead being placed upon illustrating the principles of the invention. In the figures, like reference numerals designate corresponding parts throughout the different views.

DETAILED DESCRIPTION

Figure 1:
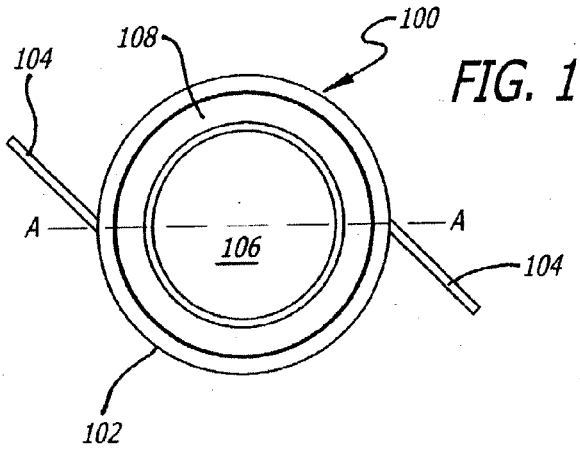
FIG. 1 is a front view of a loudspeaker driver.

FIG. 1 is a front view of an edge-driven diaphragm loudspeaker driver 100 of the invention. The loudspeaker driver 100 has a frame 102 defining a circular perimeter. A pair of hookup wires 104 are shown extending outwardly from the frame 102. Also illustrated is the diaphragm 106 and a surround member 108 positioned within the frame 102 of the loudspeaker driver 100. The construction of the diaphragm 106 and the surround member 108 within the frame 102 are further explained below.

Figure 2:
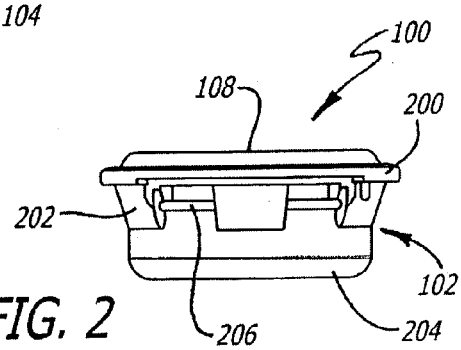
FIG. 2 is a side view of the loudspeaker driver illustrated in FIG. 1.

FIG. 2 is a side view of the loudspeaker driver 100 of FIG. 1 and illustrates the surround suspension member 108 extending upwardly from the frame 102 of the loudspeaker driver 100. FIG. 2 also illustrates the frame 102 of the loudspeaker driver 100 formed from a mounting ring 200, a polar array of buttress blocks 202 and a pot 204. The pot 204 of the frame 102 is a cupped shaped member that is engaged by the mounting ring 200, through the use of the buttress blocks 202. The mounting ring 200 is formed with the buttress blocks 202 extending downwardly, bearing against the walls of the pot 204. The mounting ring 200 is typically molded from plastic and is configured with clusters of articulated fastening members 206 by which the loudspeaker driver 100 can be mounted to an associated baffle (not shown) in a housing of the loudspeaker system. The pot 204 of the frame 102 is typically formed of metal or other like material, and may have a magnetic pole incorporated in the lower most portion of the pot 204, as illustrated in the figures.

Figure 3:
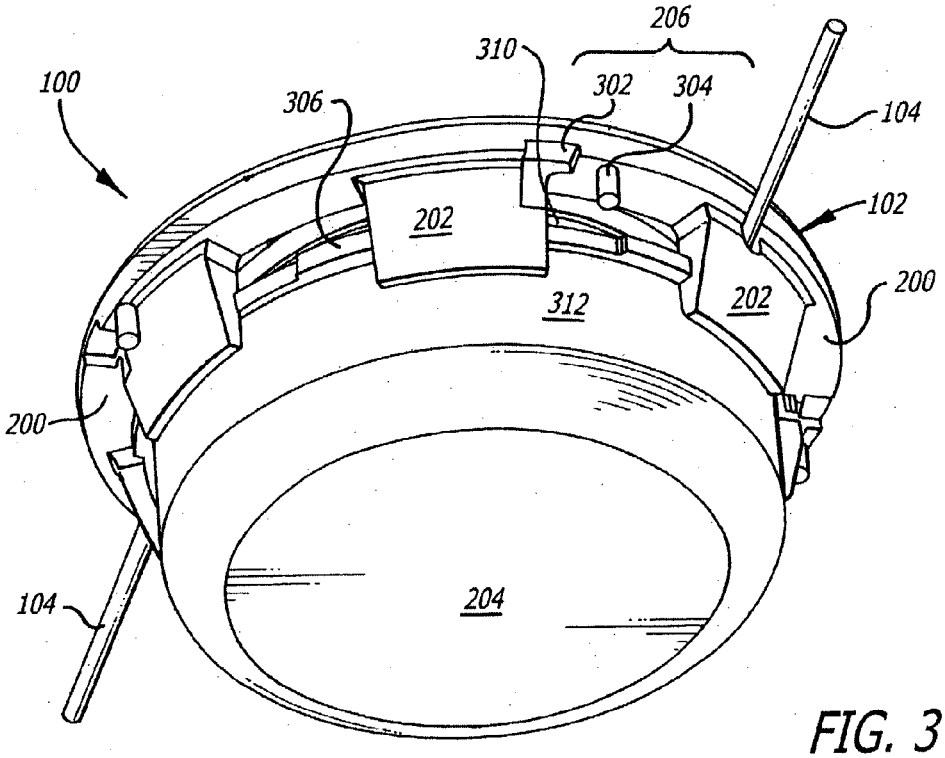
FIG. 3 is an enlarged rear perspective view of the loudspeaker driver illustrated in FIG. 1.

FIG. 3 is a rear perspective view of the loudspeaker driver 100 of FIG. 1. FIG. 3 shows the frame 102 of the loudspeaker and in particular, the mounting ring 200 having buttress blocks 202 arrayed about the underside of the mounting ring 200. The buttress blocks 202 then connect to the pot 204 of the frame 102. Also illustrated are the two hookup wires 104 extending outwardly from the loudspeaker driver 100. In operation, the hookup wires 104 may be connected through integrated flat conductors (not shown) to the loudspeaker driver voice coil, shown in FIG. 4. Typically, a total of six buttress blocks 202 are arranged in a polar array around the underside of the mounting ring 200. Each buttress block 102 is fitted closely against the wall of the pot 204 through the use of fasteners, adhesives or other securing mechanism. While the invention discloses the use of six buttress blocks 202, one skilled in the art may use various numbers of blocks 202, depending upon the size and shape of the loudspeaker driver 100. Additionally, the design of the frame 102 may also be altered by one skilled in the art.

In addition to the buttress blocks 202, the mounting ring 200 is designed with fastening members 206 for attaching the frame 102 to baffles on the interior sides of an acoustic enclosure or housing (not shown), such as a bass-reflex system or an acoustic suspension system. The fastening members 206 include a flag-shaped lock tab 302 and a rotation stop post 304, which serve to provide a snap-in attachment to the housing baffle. This snap-in fastening system can be implemented with metal springs or resilient plastic locking members. Various alternative configurations for attaching the loudspeaker driver frame 102 to the loudspeaker housing may be used and are known by those skilled in the art. Additionally, other mechanisms may be used for attaching the loudspeaker driver 100 to the housing. For example, the loudspeaker driver 100 could utilize a twist-lock mounting arrangement, involving the rotation of the speaker basket. Such a twist-lock mounting arrangement could be incorporated in conjunction with or as an alternative to the snap-in mounting described above. The loudspeaker driver may also be mounted to the housing with conventional screw hardware or other method known in the art.

The mounting ring 200 is also formed with a stepped mounting strip 306 located between each pair of adjacent buttresses 202 to further facilitate the mounting of the loudspeaker driver 100 in the loudspeaker housing. In the illustrated loudspeaker driver configuration, when the loudspeaker driver 100 is mounted against the rear baffle of the loudspeaker housing, the outer flange 508 of the surround suspension member 108 serves as a gasket, eliminating the need to provide a separate mounting gasket.

Additionally, as illustrated by FIG. 3, a plurality of apertures 310 are created between the walls 312 of the pot 204, the buttresses 202 and the mounting ring 200 to allow acoustic venting. By providing venting, the sound pressure from the rear of the diaphragm 106 can communicate to the interior of the housing of the loudspeaker system 100, which is typically a bass-reflex or an acoustic suspension system.

Figure 4:
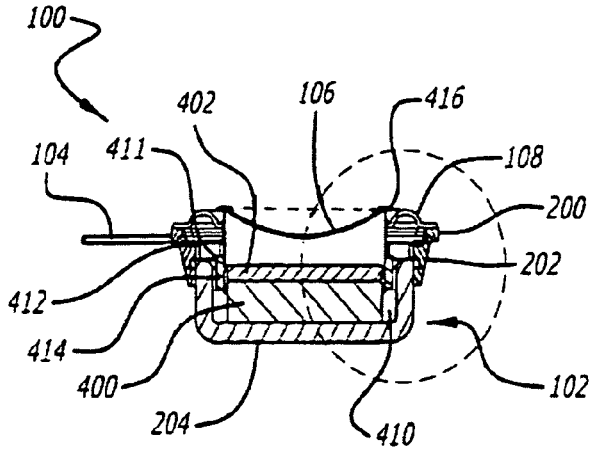
FIG. 4 is a side view of the cross-section of the loudspeaker driver illustrated in FIG. 1 taken along line A—A.

FIG. 4 is a central cross-section view of FIG. 1 taken along line a—a. FIG. 4 shows the pot 204 of the frame 102 supporting a cylindrical permanent magnet 400. Positioned above the permanent magnet 400 is a top plate 402. The permanent magnet 400 may be of any known magnet material commonly utilized in loudspeakers. The top plate 402 is typically made of a magnetically soft iron or steel but may be made from any other material suited to function as a top plate.

As seen in FIG. 4, the diameter of both the permanent magnet 400 and top plate 402 is less than the diameter of the pot 204 and the frame 102. Thus, a space 410 is formed between the interior side 404 of the pot 204 and the exterior sides 406 and 408 of the permanent magnet 400 and the top plate 402, respectively. This space 410 is known as the "magnetic air gap." A voice coil 411, comprised of a former 412 wound with a voice coil wire 414 is then positioned within the magnetic air gap 410 and extends upwardly to join to the diaphragm 106 at its outer perimeter 416. The voice coil former 412 and connecting diaphragm 106 are then supported in place by a surround suspension member 108 that is connected to the voice coil former 412, as further described below. The voice coil 411 may also include a wrapper (not shown) that encases the voice coil former 412. Thus, when reference is made to connecting or attaching the suspension member or any other speaker component to the voice coil former 412, the attachment may be made either directly to the wrapper of the voice coil former 412 or directly to the voice coil former 412 when the former 412 is absent a wrapper. One skilled in the art will recognize that other configurations of the pot 204, permanent magnet 400, top plate 402 and voice coil 411 may be utilized without departing from the scope of the invention.

In this embodiment, the diaphragm 106 is seen to have a concave shape; however, one skilled in the art will recognize the edge-driven diaphragm driver configuration can be used with a diaphragm 106 of other shapes, such as a convex diaphragm. The concave shape of diaphragm 106 is used to reduce the height of the loudspeaker driver 100 to provide an overall lower profile package that is often desired for use in smaller applications, such as loudspeakers designed for use in lap top computers. The diaphragm 106 may be made from any suitable material that provides rigidity, such as titanium, aluminum or other metal, or non-metal material, such as plastic or impregnated/reinforced paper, or various impregnated textiles.

Figure 5:
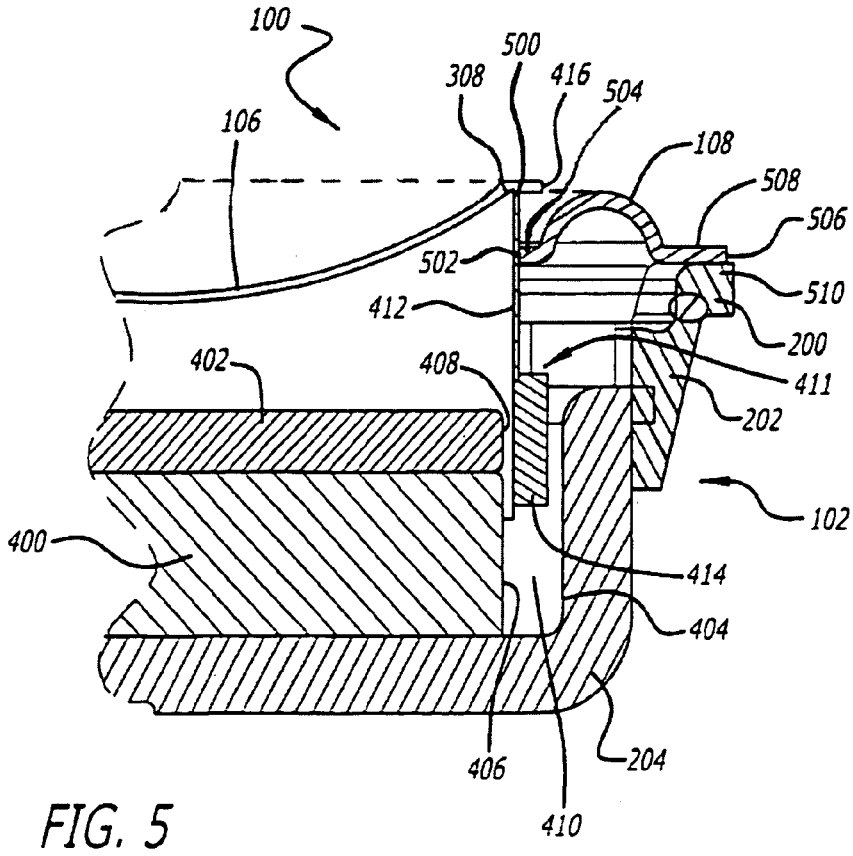
FIG. 5 is an enlarged view of the encircled portion of the loudspeaker driver illustrated in FIG. 4.

FIG. 5 is an enlarged view of the encircled region of FIG. 4 and provides a more detailed illustration of the configuration of the suspension member 108 relative to the voice coil 411 and diaphragm 106. As described above, a voice coil 411, which generally consists of a voice coil former 412, wound with a voice coil wire 414, is positioned in the magnetic air gap 410 between interior side 404 of the pot 204 of the frame 102 and the exterior sides 406 and 408 of the permanent magnet 400 and top plate 402, respectively.

The voice coil 411 then extends upward , in a direction parallel to the sides 406 and 408 of the permanent magnet 400 and top plate 402 and out of the magnetic air gap 410. In this embodiment, the voice coil former 412 extends upward, to a point slightly above the mounting ring 200 of the frame 102, to connect with the diaphragm 106 of the loudspeaker driver 100. The voice coil former 412 attaches to the diaphragm 106 at its upper end 500. The upper end 500 of the voice coil former attaches to the underside of the outer perimeter edge 416 of the diaphragm 106 via an adhesive or other mechanism known in the art for mounting the diaphragm 106 to the voice coil former 412. In this embodiment, the outer perimeter edge 416 is formed as a flat narrow flange; however, alternative perimeter edge 416 configurations may be used to attach the diaphragm 106 to the voice coil former 412. For example, the diaphragm 106 may be formed with an annular downward-facing channel that could flank the upper end 500 of voice coil former 412 to facilitate locating and fastening operations.

As illustrated by FIG. 5, the surround suspension member 108 is attached to the voice coil former 412 to support the voice coil 411 and diaphragm 106 and to maintain the alignment of the voice coil 411 in the magnetic air gap 410. The surround suspension member 108 includes an inner edge 502, which may include a short flange 504, as shown. The inner edge 502 of the surround suspension member 108 is attached to the voice coil former 412 at a location beneath the point at which the diaphragm 106 attaches to the upper end 500 of the voice coil former 412. The outer edge 506 of the surround suspension member 108 is attached to the mounting ring 200 via an outer flange 508 of the surround suspension member 108. The mounting ring 200 includes an annular flat forward-facing suspension-attachment surface 510 for receiving the outer flange 508 of the surround suspension member 108.

The surround suspension member 108 is configured and arranged to provide a degree of constraint to the maximum excursions of the voice coil/diaphragm assembly in both the upward direction, which is not constrained otherwise, and in the lower direction, where the suspension acts to cushion the voice c oil 411 from the pot 204. While the current configuration shows the suspension member having an arc subtending an angle of 180 degrees or slightly less, the invention could be practiced utilizing known alternate configurations of surround suspension member 108, e.g., a series of concentric corrugations.

In one embodiment of the loudspeaker driver 100, the loudspeaker driver 100 may be approximately 31 mm in overall diameter by 14 mm in depth. The diaphragm 106 may be concave to a maximum depth of 2.6 mm. The exterior perimeter of the voice coil 411 and the concave portion of the diaphragm 106 are approximately 19 mm in diameter. The voice coil 411 is approximately 2.9 mm in length and the magnetic air gap space 410 is approximately 1.47 mm. The pot 204 is approximately 1.75 mm thick, the permanent magnet 400 is approximately 3.77 mm thick and the top plate 402 is approximately 1.4 mm thick.

With the above set of loudspeaker driver dimensions, the voice coil former 412 is made to extend upwardly 4.3 mm beyond the voice coil 411. The location designated for attachment of the surrounds suspension member 108 along the voice coil 411 is chosen to be 1.6 mm from the upper edge 500 of the voice coil former 412, which in a speaker system of these dimensions would make the top of the arc of the surround suspension member 108 flush with the inner edge 308 of the diaphragm 106. Proper selection of material of the surround suspension member 108 and its fastening location along the free region of voice coil former 412 act to cushion and isolate the diaphragm 106 and ensure that the voice coil 411 is constrained coaxially in the magnetic air gap 410 while it vibrates longitudinally. Thus, the voice coil 411 movement is maintained to a straight line and made free of rocking or other extraneous movement.

Further, the clearance allowed for the excursion of the voice coil/diaphragm assembly in an assembly of the above dimensions is approximately 2.55 mm at two potential bottoming locations: (i) between the lower extremity of the voice coil former 412 and the floor of pot 204; and (ii) between the lower extremity of diaphragm 106 and top plate 402. Thus, a maximum symmetrical excursion range of 5.1 mm peak-to-peak is provided.

As a size efficiency factor, the excursion can be compared to the total thickness of the loudspeaker. For a hypothetical cylindrical loudspeaker of given diameter with a cone of equal diameter and a peak-to-peak excursion equal to the loudspeaker thickness, this factor would be 100%. That is, the volume of displaced air would equal the volume of the loudspeaker itself. In a loudspeaker driver 100 of the dimensions given above, this factor would be 5.1 mm/12 mm or 42.5%, compared to a percentage typically of less than 10% for conventional loudspeakers.

The above loudspeaker dimensions are given by way of example only. One skilled in the art will recognize that the above configuration can be incorporated into speaker systems of various sizes and shapes and is not limited to the dimension described above, but may vary based upon the desired application.

While various embodiments of the invention have been described, it will be apparent to those of ordinary skill in the art that many more embodiments and implementations are possible within the scope of this invention. Accordingly, the invention is not to be restricted except in light of the attached claims and their equivalents.

What is claimed is:

1. A loudspeaker comprising:

a voice coil disposed around a central region of the loudspeaker;

a suspension member extending generally outwardly from the central region and including an inner edge attached to the voice coil; and a diaphragm secured to the voice coil, where the diaphragm is free of attachment to any suspension members.

2. The loudspeaker of claim 1, where the voice coil has a voice coil former having an upper end and a lower end, the voice coil former being attached to the diaphragm at its upper end.

3. The loudspeaker of claim 2, where the voice coil former has a voice coil wire about its lower end.

4. The loudspeaker of claim 2, further including a frame and where the suspension member includes an outer edge attached to the frame.

5. The loudspeaker of claim 4, where both the inner and outer edges of the suspension member are flanges.

6. The loudspeaker of claim 4, where the cross-section of the suspension member between the inner and outer edges is configured generally as an arc.

7. The loudspeaker of claim 1, where the diaphragm is a concave shaped diaphragm.

8. The loudspeaker of claim 1, where the diaphragm is a convex shaped diaphragm.

9. The loudspeaker of claim 1, further comprising a permanent magnet.

10. The loudspeaker of claim 1, where the suspension member is the only suspension member in the loudspeaker.

11. A loudspeaker comprising:

a voice coil having a voice coil former with an upper end and a lower end;

a voice coil wire wound to the lower end of the voice coil former around a central region of the loudspeaker;

a diaphragm secured to the upper end of the voice coil former, where the diaphragm is not directly supported by any suspension members; and a suspension member extending generally outwardly from the central region and including an inner edge attached to the voice coil former at a point on the voice coil former beneath the point at which the diaphragm attaches to the voice coil former.

12. The loudspeaker of claim 11, where the diaphragm is a concave shaped diaphragm.

13. The loudspeaker of claim 11, where the diaphragm is a convex shaped diaphragm.

14. The loudspeaker of claim 11, further including a frame and where the suspension member includes an outer edge attached to the frame.

15. The loudspeaker of claim 14, where both the inner and outer edges of the suspension member are flanges.

16. The loudspeaker of claim 14, where the cross-section of the suspension member between the inner and outer edges is configured generally as an arc.

17. The loudspeaker of claim 11, further comprising a permanent magnet.

18. The loudspeaker of claim 11, where the suspension member is the only suspension member in the loudspeaker.

19. A loudspeaker comprising:

a voice coil disposed around a central region of the loudspeaker;

a suspension member extending generally outwardly from the central region and including an inner edge attached to the voice coil; and a diaphragm having a perimeter that is of substantially the same size as the perimeter of the voice coil and secured to the perimeter of the voice coil and where the diaphragm is free of attachment to any suspension members.

20. The loudspeaker of claim 19, where the voice coil has a voice coil former having an upper end and a lower end, the voice coil former being attached to the diaphragm at its upper end.

21. The loudspeaker of claim 20, where the voice coil former has a voice coil wire about its lower end.

22. The loudspeaker of claim 20, further including a frame and where the suspension member includes an outer edge attached to the frame.

23. The loudspeaker of claim 22, where both the inner and outer edges of the suspension member are flanges.

24. The loudspeaker of claim 22, where the cross-section of the suspension member between the inner and outer edges is configured generally as an arc.

25. The loudspeaker of claim 19, where the diaphragm is a concave shaped diaphragm.

26. The loudspeaker of claim 19, where the diaphragm is a convex shaped diaphragm.

27. The loudspeaker of claim 19, further comprising a permanent magnet.

28. The loudspeaker of claim 19, where the suspension member is the only suspension member in the loudspeaker.

29. A loudspeaker comprising:

a frame;

a voice coil;

a suspension member having an inner edge and an outer edge, the inner edge of the suspension member is attached to the voice coil and the outer edge of the suspension member is attached to the frame; and a diaphragm secured to the voice coil, where the diaphragm is free of attachment to any suspension members and to the frame.

30. The loudspeaker of claim 29, where the voice coil has a voice coil former having an upper end and a lower end, the voice coil former being attached to the diaphragm at its upper end.

31. The loudspeaker of claim 30, where the voice coil former has a voice coil wire about its lower end.

32. The loudspeaker of claim 29, where the diaphragm is a concave shaped diaphragm.

33. The loudspeaker of claim 29, where the diaphragm is a convex shaped diaphragm.

34. The loudspeaker of claim 29, further comprising a permanent magnet.

35. The loudspeaker of claim 29, where the suspension member is the only suspension member in the loudspeaker.

36. The loudspeaker of claim 29, where both the inner and outer edges of the suspension member are flanges.

37. The loudspeaker of claim 29, where the cross-section of the suspension member between the inner and outer edges is configured generally as an arc.

38. A loudspeaker comprising:

a frame;

a voice coil;

a suspension member having an inner edge and an outer edge, the inner edge of the suspension member is attached to the voice coil and the outer edge of the suspension member is attached to the frame; and a diaphragm having a perimeter that is of substantially the same size as the perimeter of the voice coil, the diaphragm being secured to perimeter of the voice coil and free of attachment to any suspension members or to the frame.

39. The loudspeaker of claim 38, where the voice coil has a voice coil former having an upper end and a lower end, the voice coil former being attached to the diaphragm at its upper end.

40. The loudspeaker of claim 39, where the voice coil former has a voice coil wire about its lower end.

41. The loudspeaker of claim 38, where the diaphragm is a concave shaped diaphragm.

42. The loudspeaker of claim 38, where the diaphragm is a convex shaped diaphragm.

43. The loudspeaker of claim 38, further comprising a permanent magnet positioned within the frame.

44. The loudspeaker of claim 38, where the suspension member is the only suspension member in the loudspeaker.

45. The loudspeaker of claim 38, where both the inner and outer edges of the suspension member are flanges.

46. The loudspeaker of claim 38, where the cross-section of the suspension member between the inner and outer edges is configured generally as an arc.

47. A loudspeaker comprising:

a frame;

a voice coil;

a suspension member including an inner edge and an outer edge, the inner edge attached to the voice coil and the outer edge attached to the frame; and a diaphragm secured to the voice coil, where the diaphragm is free of attachment to any suspension members.

48. The loudspeaker of claim 47, where the voice coil includes a former and the suspension member is attached to the former.

49. The loudspeaker of claim 47 comprising a frame, where the suspension member extends outwardly to the frame.

50. A loudspeaker comprising:

a voice coil including an inwardly facing side and an outwardly facing side;

a suspension member attached to the outwardly facing side; and a diaphragm secured to the voice coil, where the diaphragm is free of attachment to any suspension members.

51. The loudspeaker of claim 50, where the voice coil includes a former and the former includes the outwardly facing side.

52. The loudspeaker of claim 50 comprising a frame, where the suspension member extends outwardly to the frame.

53. A loudspeaker comprising:

a voice coil;

a suspension member having an annular configuration and including an inner edge defining a central opening of the suspension member, where the inner edge is attached to the voice coil; and a diaphragm secured to the voice coil, where the diaphragm is free of attachment to any suspension members.

54. The loudspeaker of claim 53, where the voice coil includes a former and the inner edge of the suspension member is attached to the former.

55. The loudspeaker of claim 53 comprising a frame, where the suspension member extends outwardly to the frame.

56. A loudspeaker comprising:

a frame defining a perimeter;

a voice coil disposed within the perimeter;

a suspension member attached to the voice coil and extending generally outwardly toward the perimeter; and a diaphragm secured to the voice coil, where the diaphragm is free of attachment to any suspension members.

57. The loudspeaker of claim 56 where the suspension member is attached to the frame.

58. The loudspeaker of claim 56 where the frame includes a mounting ring and the suspension member is attached to the mounting ring.

* * * * *